US010299050B2

(12) United States Patent
Gordon et al.

(10) Patent No.: US 10,299,050 B2
(45) Date of Patent: May 21, 2019

(54) MOBILE AUDIO RECEIVER

(71) Applicant: Auditory Labs, LLC, Westlake, OH (US)

(72) Inventors: Brian T. Gordon, Westlake, OH (US); Nadia M. Gordon, Westlake, OH (US)

( * ) Notice: Subject to any disclaimer, the term of this patent is extended or adjusted under 35 U.S.C. 154(b) by 0 days.

(21) Appl. No.: 14/837,764

(22) Filed: Aug. 27, 2015

(65) Prior Publication Data

US 2016/0066106 A1 Mar. 3, 2016

Related U.S. Application Data

(60) Provisional application No. 62/042,331, filed on Aug. 27, 2014.

(51) Int. Cl.
*H04R 25/00* (2006.01)

(52) U.S. Cl.
CPC ..... *H04R 25/556* (2013.01); *H04R 2420/09* (2013.01)

(58) Field of Classification Search
CPC ..... H04R 25/556; H04R 2420/09
USPC ..... 381/312
See application file for complete search history.

(56) References Cited

U.S. PATENT DOCUMENTS 5,721,783 A * 2/1998 Anderson ..... H04B 1/385 381/312
7,151,488 B2 * 12/2006 Wakamori ..... G01S 19/35 342/357.75
2008/0031475 A1 * 2/2008 Goldstein ..... H04M 1/05 381/151
2011/0170708 A1 * 7/2011 Zhu ..... H04M 1/0202 381/94.1
2013/0148828 A1 * 6/2013 Fort ..... A61N 1/36032 381/312
2013/0343585 A1 * 12/2013 Bennett ..... H04R 25/554 381/315
2014/0074466 A1 * 3/2014 Sharifi ..... G06F 17/30026 704/235

* cited by examiner

*Primary Examiner* — Sean H Nguyen
(74) *Attorney, Agent, or Firm* — McCarthy, Lebit, Crystal & Liffman, Co. LPA

(57) ABSTRACT

An assistive listening device that comprises a receiver for a digital signal that is tuned to receive a particular digital signal and a connector that includes a permanently mounted Apple Lightning or a mini/micro type-B or type-C USB connector or a standard type-A USB connector that serves as a conduit for a digital signal to a recoding or retransmittal device and as a conduit for transferring power to the mobile assistive listening device.

7 Claims, 6 Drawing Sheets

MOBILE AUDIO RECEIVER

RELATED APPLICATIONS

This application claims the benefit of provisional patent application Ser. No. 62/042,331 ('331) and its filing date Aug. 27, 2014. The present invention incorporates all of the subject matter disclosed in '331 as if it were fully rewritten herein.

FIELD OF INVENTION

The present invention is in the field of assistive listening devices for the deaf and hard of hearing or other persons with disabilities.

SUMMARY OF INVENTION

An assistive listening device that comprises a receiver for a digital signal and a connector that serves as a conduit for the signal to a recoding or retransmittal device, preferably a handheld mobile device. The assistive listening device is powered externally through that permanently mounted connective interface. Methods employing the assistive listening device to convert human voice audio to text at locations remote from the speaker are also disclosed and claimed.

DETAILS OF INVENTION

The invention is a peripheral component device that receives human voice audio transmitted by a digital transmitter with microphone, often referred to as a personal FM or DM system, and transmits that human voice audio to a mobile device, and methods employing the same.

DESCRIPTION OF PREFERRED EMBODIMENTS

Figure 1:
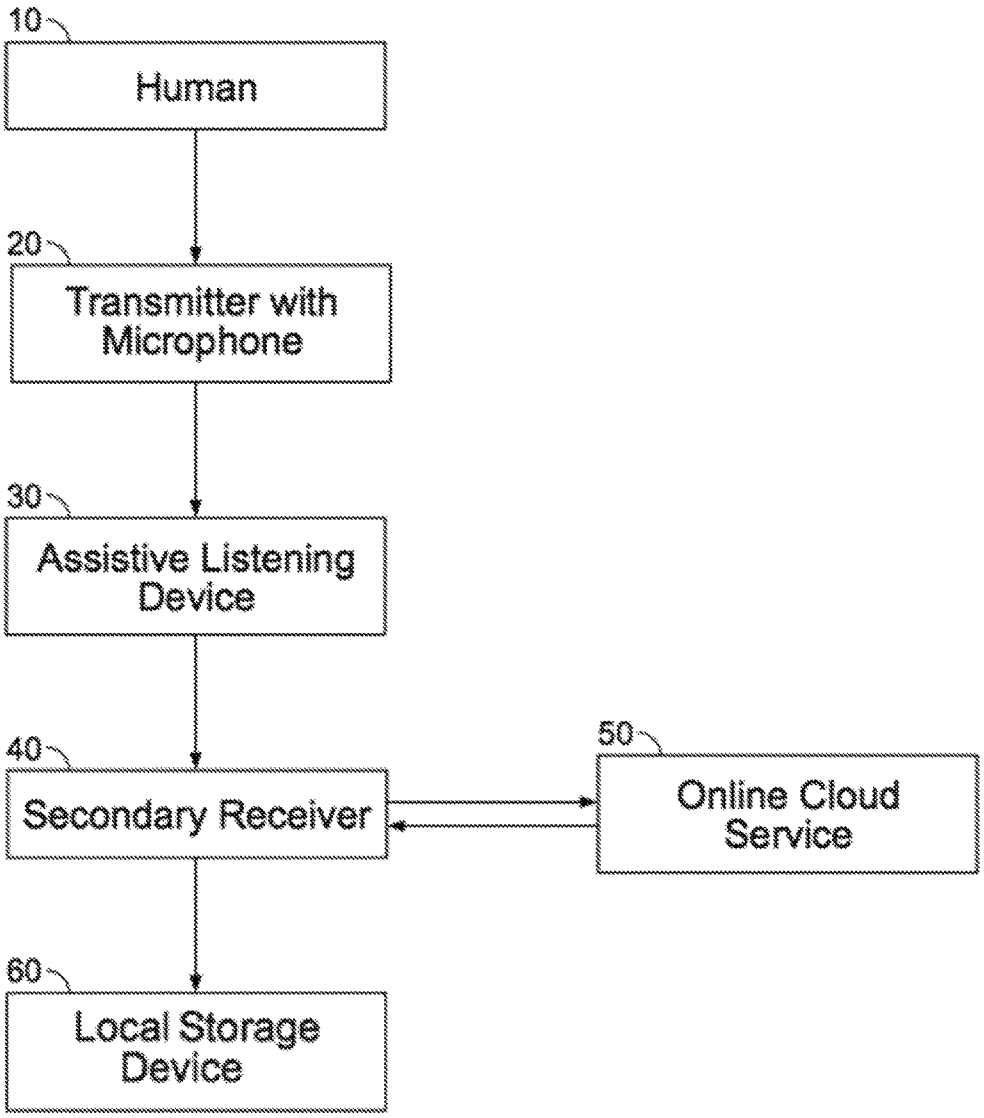
FIG. 1 is a flow diagram depicting the flow of information or signals through the entire system.

Referring initially to the drawings, FIG. 1 is a flow diagram that includes the assistive listening device of the instant invention. The assistive listening device of the instant invention is used normally with spoken voice audio emanating from human 10, which may be live or recorded. Additional sounds may also be included.

Audio emanating from human 10 is transmitted via initial transmitter with microphone 20 which is then received into the assistive listening device 30 that comprises a digital receiver. The carrier frequency transmitted by initial transmitter 20 to be received by the digital receiver includes, but is not limited to 2.4 GHz. The 2.4 GHz communication platform may be of a proprietary nature or license free. A proprietary communication platform may include but is not limited to the Phonak Roger 2.4 GHz communication platform. The initial transmitter with microphone 20 may be any one of a number of commercially available digital transmitters that include a microphone 20, such as are used in the classroom for the deaf and hard of hearing. Commercially available devices include but are not limited to Phonak Roger Inspiro, Phonak Roger Clip-on Mic, Phonak Roger Pen, Oticon Amigo family, and others.

Figure 6:
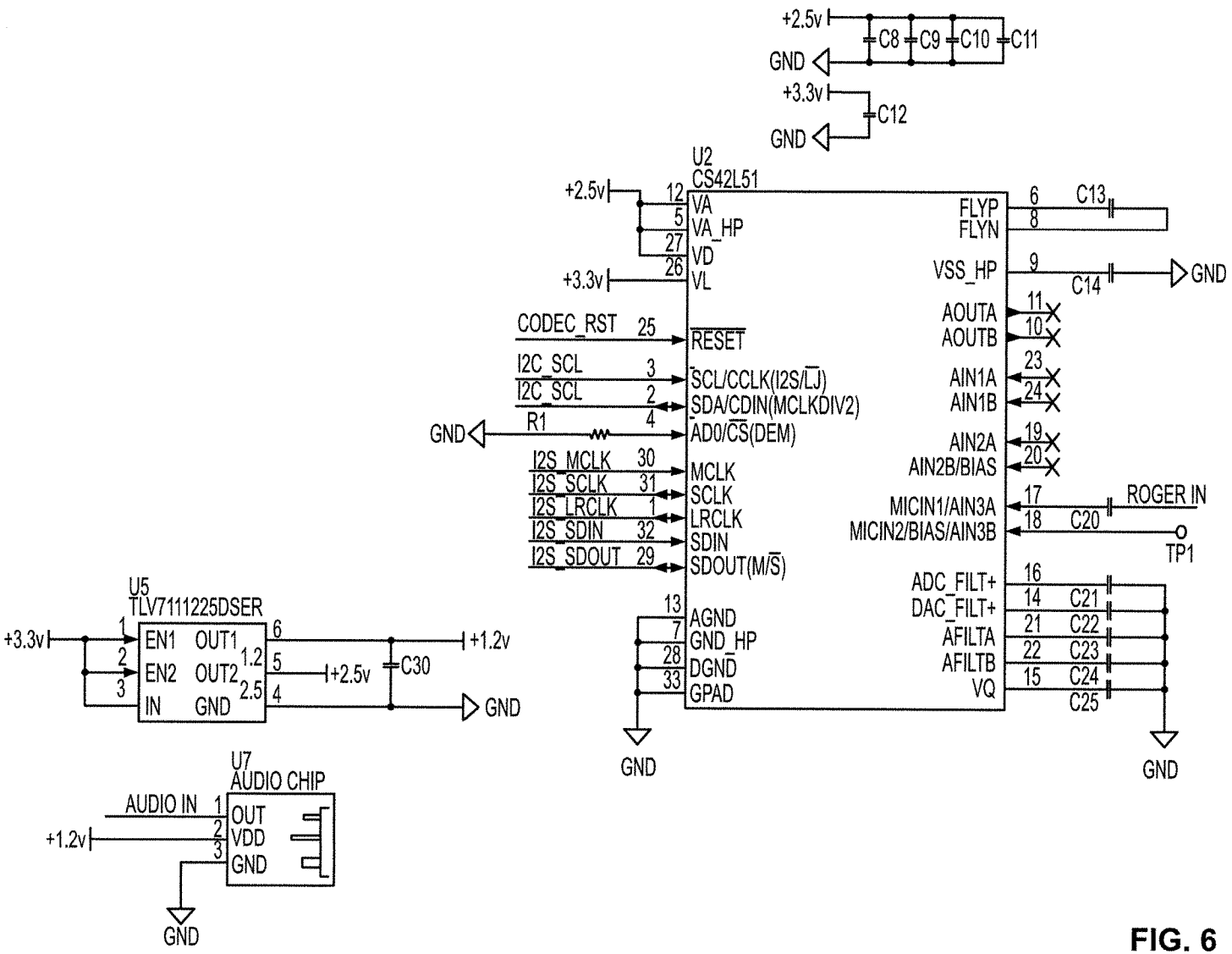
FIG. 6 is the electrical schematic of the assistive listening device.
Figure 6:
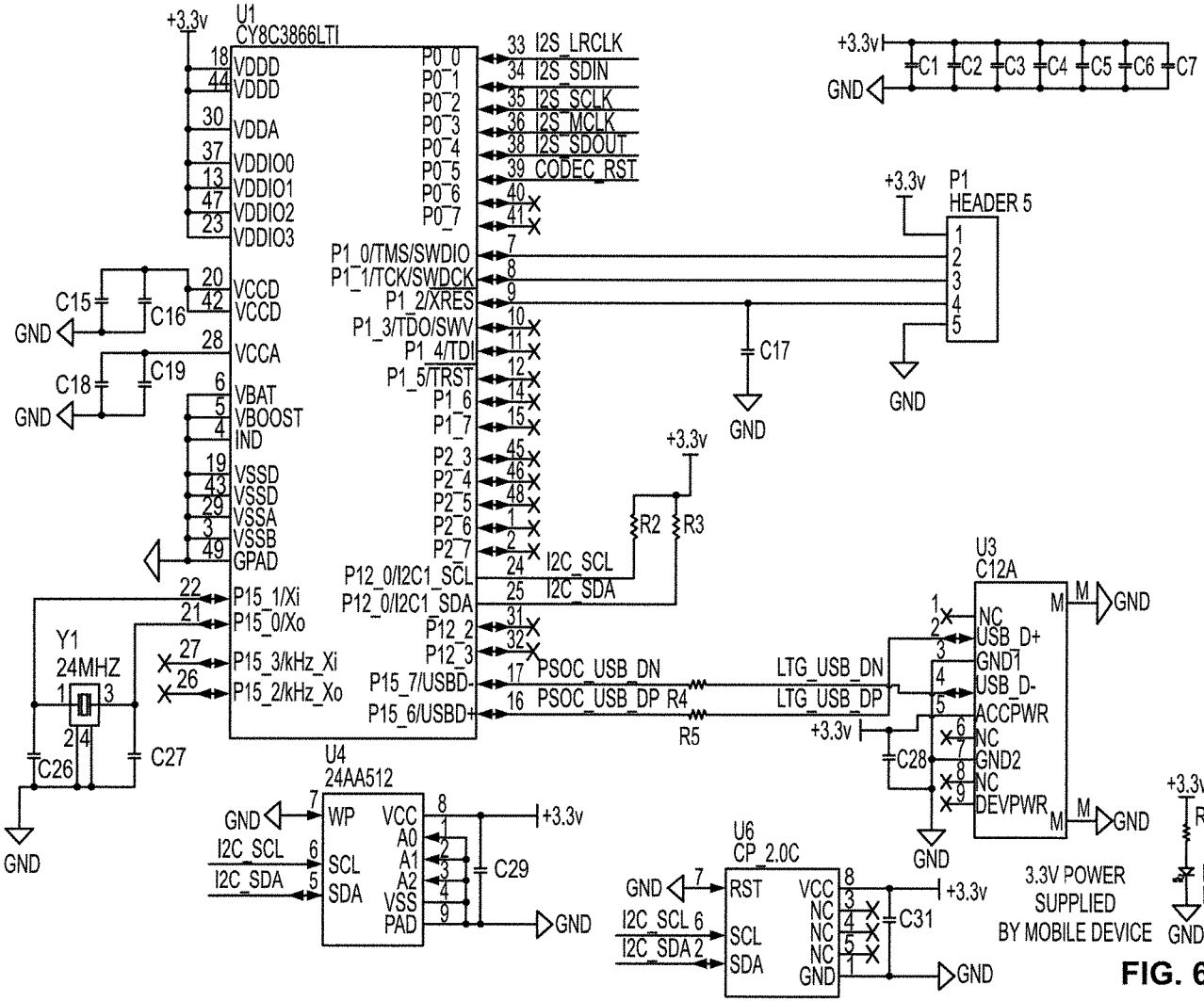

The assistive listening device 30 comprises electronic hardware including a digital receiver for the purpose of receiving the digital signal emanating from the transmitter 20, then transmitting the signal to a secondary receiver 40 for further handling or manipulation. As one skilled in the art would appreciate with reference to FIG. 6, assistive listening device 30 comprises a radio frequency receiver set or adjustably set to the frequency of transmitter with microphone 20, and a retransmitter to transmit signal to secondary receiver 40.

There is software resident in the secondary receiver component 40 that controls the recordation of the audio received therein and that stores such audio (as digital signal) on either a local storage device 60 of the secondary receiver component 40 or at an online cloud service 50 for later playback and perhaps further manipulation. The software in the secondary receiver component 40 also has the ability to send the recorded audio to an offsite location via the Internet to be transcribed using any one of a number of commercially available machine or human generated transcription services. Optionally, the software in the secondary receiver component 40 also has the ability to create, control and receive transcriptions from any one of a number of commercially available machine or human generated transcription services. Commercially available machine or human generated transcription services includes but are not limited to Nuance, VoiceBase, Apple Siri, Google Voice Recognition and others.

The interface between the assistive listening device 30 of the instant invention and the secondary receiver component 40 is accomplished mechanically through a permanently mounted connector such as an Apple Lightning connector 33 or a mini/micro type-B or type-C USB connector 35 or a standard type-A USB connector 37. The secondary receiver component 40 is any one of a number of well-known devices that may be used to accept an Apple Lightning connector 33 or a mini/micro type-B or type-C USB connector 35 or a standard type-A USB connector 37 to receive a signal broadcast from the assistive listening device 30. The secondary receiver component 40 devices include, but are not limited to, laptop computers, mobile smartphones and tablet computers of any screen size. The secondary receiver component 40 may employ an application or software that enables power transfer to the assistive listening device 30.

The assistive listening device 30 is composed of a printed circuit board assembly (PCBA) that itself is comprised of well-known electronic components. Power is provided to the components externally through an Apple Lightning connector 33 or a mini/micro type-B or type-C USB connector 35 or a standard type-A USB connector 37 interface. The PCBA includes circuitry for transferring power from the secondary receiver 40 to assistive listening device 30 via the permanently mounted Apple Lightning connector 33 or a mini/micro type-B or type-C USB connector 35 or a standard type-A USB connector 37 interface. The assistive listening device 30 may also include automatic channel tuning or may include frequency-hopping technology.

Alternately, the assistive listening device 30 may have power provided to the components through one or more disposable or rechargeable batteries.

The software in the secondary receiver component 40 may be a mobile application also referred to as an app, in which the graphical user interface would include but not be limited to "soft" buttons for powering and control of the assistive listening device 30. Features of the software portion of the invention are not limited to those mentioned above.

The mobile operating systems for the mobile application can include but are not limited to Apple iOS, Apple OS X, Google Android, Google Chrome and Microsoft Windows.

Figure 2:
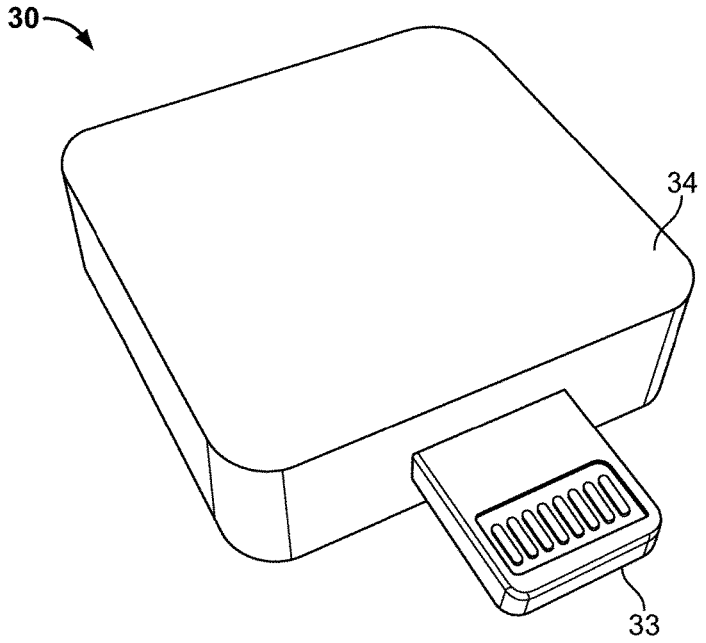
FIG. 2 depicts one embodiment of the assistive listening device.
Figure 3:
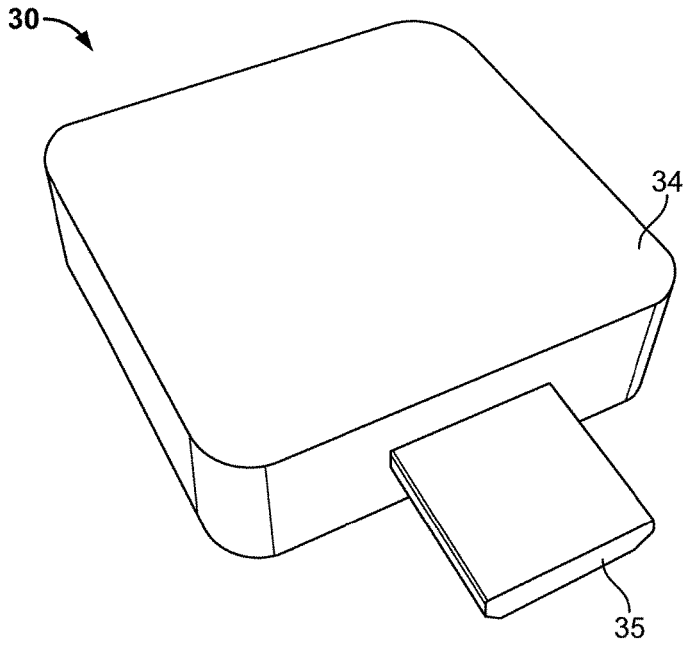
FIG. 3 depicts another embodiment of the assistive listening device.
Figure 4:
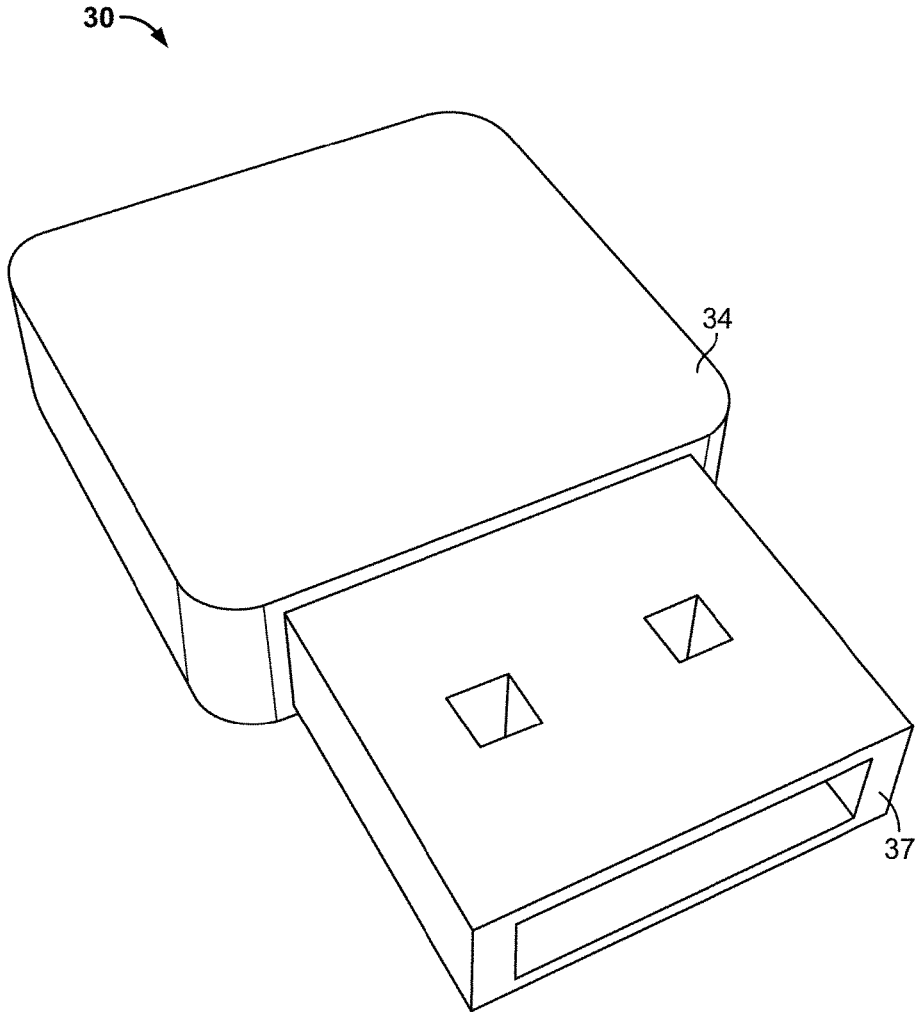
FIG. 4 depicts another embodiment of the assistive listening device.
Figure 5:
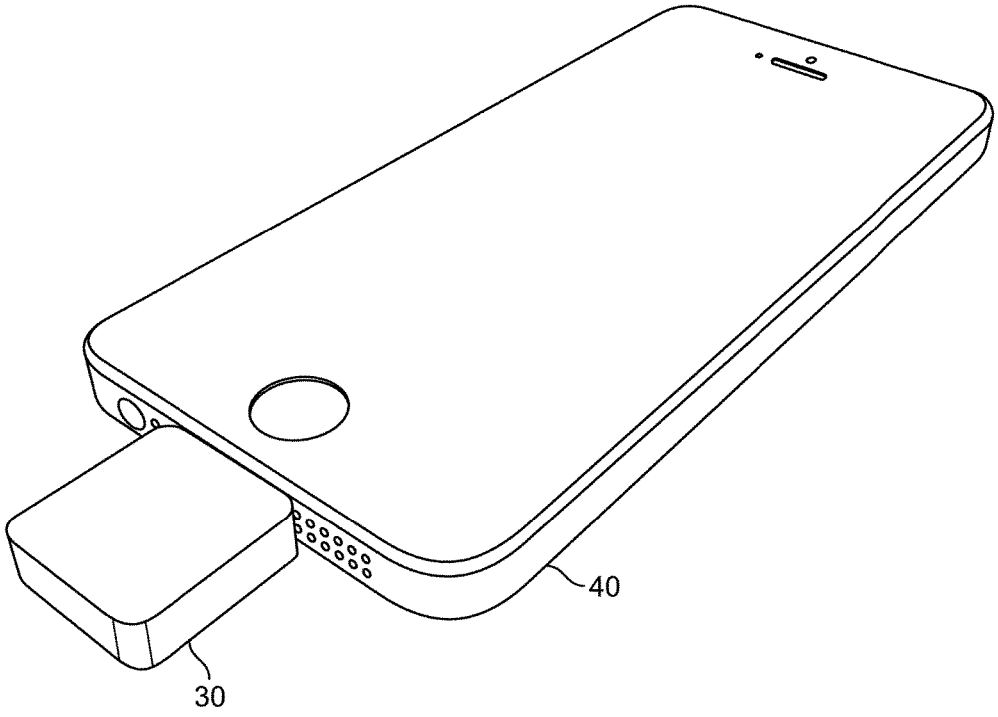
FIG. 5 depicts the assistive listening device connected to a mobile device.

FIGS. 2, 3 and 4 depict three possible designs of the assistive listening device 30. Showing the external case 34 along with an Apple Lightning connector 33 or a mini/micro type-B or type-C USB connector 35 or a standard type-A USB connector 37.

A first use case is a student of any age that may be deaf or hard of hearing using the invention in a classroom setting. The teacher or classroom lecturer would wear a personal FM or digital transmitter with or without a boom microphone and the student would use the invention to transmit audio directly to a mobile device.

A second use case is an individual of any age that may be deaf or hard of hearing or having some other special need using the invention in settings such as theaters, places of worship, museums, public meeting places, corporate conference rooms, convention centers, and other large areas for gathering to transmit audio directly to a mobile device.

The foregoing descriptions of specific embodiments of the present invention are presented for purposes of illustration and description. They are not intended to be exhaustive nor are they intended to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the drawings and specification appended hereto and to their equivalents. Therefore, the scope of the invention is in no way to be limited only by any adverse inference under the rulings of *Warner-Jenkinson Company,* v. *Hilton Davis Chemical*, 520 U.S. 17 (1997) or *Festo Corp.* v. *Shoketsu Kinzoku Kogyo Kabushiki Co.*, 535 U.S. 722 (2002), or other similar caselaw or subsequent precedent should not be made if any future claims are added or amended subsequent to this patent application.

What is claimed is:

1. A multi-user assistive listening system to enhance a primary user's ability to capture and interpret continuous spoken word from one or more secondary users by means of voice recognition software comprising, in combination:

a remote mobile computing device;

a digital audio transmitter comprising a stand-alone microphone wherein said stand-alone microphone is separate from said remote mobile computing device for transmitting a digital audio signal of a human voice;

a stand-alone auditory interpretation device, wherein said stand-alone auditory interpretation device is a peripheral component to said remote mobile computing device, comprising in combination:

a first digital receiver set at a selected frequency for receiving said digital audio signal from said stand-alone microphone;

a second digital transmitter for retransmitting said digital audio signal to a second digital receiver; and an interface between said second digital transmitter and a second digital receiver on said remote computing device comprising a non-wired electromechanical connection;

wherein said second digital receiver on said remote computing device is for receiving said retransmitted digital signal; and wherein a storage means is located on said remote mobile computing device for storing the retransmitted digital signal as a stored digital file.

2. The assistive listening system as claimed in claim 1, further comprising voice recognition software means for converting said stored digital file to a transcription of the digital audio signal of the human voice for display to said primary user.

3. The assistive listening system as claimed in claim 2, further comprising power means for said first digital receiver and second digital transmitter comprising a circuit internal to the auditory interpretation device that transfers power from said remote mobile computing device to said auditory interpretation device through said non-wired electromechanical connection.

4. The assistive listening system as claimed in claim 3 wherein the said storage means is capable of storing the transcription of the digital audio signal for later display to said primary user.

5. The assistive listening system as claimed in claim 4 wherein the voice recognition software means to transcribe the stored digital file is remote from the storage means.

6. The assistive listening system as claimed in claim 5 wherein the second digital receiver is capable of delivering the transcription of the digital audio signal to said primary user from the storage means.

7. A multi-user assistive listening system to enhance a primary user's ability to capture and interpret continuous spoken word from one or more secondary users by means of voice recognition software comprising, in combination:

a remote mobile computing device;

a digital audio transmitter comprising a stand-alone microphone wherein said stand-alone microphone is separate from said remote mobile computing device for transmitting a digital audio signal of a human voice;

a stand-alone auditory interpretation device, wherein said stand-alone auditory interpretation device is a peripheral component to said remote mobile computing device, comprising in combination:

a first digital receiver set at a selected frequency for receiving said digital audio signal from said stand-alone microphone;

a second digital transmitter for retransmitting said digital audio signal to a second digital receiver wherein said second digital receiver on said remote mobile computing device is for receiving said retransmitted digital signal; and an interface between said second digital transmitter and a second digital receiver on said remote mobile computing device comprising a non-wired electromechanical connection;

wherein a storage means is located on said remote mobile computing device for storing the retransmitted digital signal as a stored digital file;

a voice recognition software means for converting said stored digital file to a transcription of the digital audio signal of the human voice for display to said primary user;

a power means for said first digital receiver and second digital transmitter comprising a circuit internal to the auditory interpretation device that transfers power from said remote mobile computing device to said auditory interpretation device through said non-wired electro-mechanical connection;

wherein the storage means is capable of storing the transcription of the digital audio signal for later display to said primary user;

wherein the voice recognition software means to transcribe the stored digital file is remote from the storage means; and wherein the second digital receiver is capable of delivering the transcription of the digital audio signal to said primary user from the storage means.

* * * * *